US012594477B2

(12) United States Patent
Kensrud et al.

(10) Patent No.: US 12,594,477 B2
(45) Date of Patent: Apr. 7, 2026

(54) FLEX GRIP SPORTS BALL PITCHING MACHINE TIP

(71) Applicant: WASHINGTON STATE UNIVERSITY, Pullman, WA (US)

(72) Inventors: Jeffrey Ryan Kensrud, Pullman, WA (US); Derek Durand Nevins, Pullman, WA (US)

(73) Assignee: Washington State University, Pullman, WA (US)

( * ) Notice: Subject to any disclaimer, the term of this patent is extended or adjusted under 35 U.S.C. 154(b) by 160 days.

(21) Appl. No.: 16/613,847

(22) PCT Filed: May 16, 2017

(86) PCT No.: PCT/US2017/032887
§ 371 (c)(1),
(2) Date: Nov. 15, 2019

(87) PCT Pub. No.: WO2018/212763
PCT Pub. Date: Nov. 22, 2018

(65) Prior Publication Data

US 2020/0179784 A1 Jun. 11, 2020

(51) Int. Cl.
*A63B 69/40* (2006.01)
*A63B 69/00* (2006.01)
(Continued)

(52) U.S. Cl.
CPC ..... *A63B 69/409* (2013.01); *A63B 69/36* (2013.01); *A63B 69/0002* (2013.01);
(Continued)

(58) Field of Classification Search
CPC . A63B 69/406; A63B 2069/402; A63B 69/40; A63B 69/00; A63B 69/409;
(Continued)

(56) References Cited

U.S. PATENT DOCUMENTS 2,182,369 A * 12/1939 Barron ..... A63B 69/409 124/81
2,574,408 A * 11/1951 Moe ..... A63B 69/409 124/73
(Continued)

FOREIGN PATENT DOCUMENTS

CA 2676348 A1 * 2/2021
DE 3601188 C2 * 7/1987 ..... A63B 69/406
(Continued)

OTHER PUBLICATIONS https://www.engineeringtoolbox.com/friction-coefficients-d_778.html (Year: 2010).*

*Primary Examiner* — Eugene L Kim
*Assistant Examiner* — Amir A Klayman
(74) *Attorney, Agent, or Firm* — WCF IP

(57) ABSTRACT

A unique configuration is introduced herein for providing a ball machine pitching tip. A linear actuator is coupled to the disclosed ball tip herein having at least one member protruding outwardly from a base and radially positioned about a coupling aperture. Positioned selected frictional contact points configured to an inner surface of the at least one protruding member enables an imbalance of torque on the object as released from the gripping tip from a velocity provided by the linear accelerator. The result is the ability to provide a variety of flight patterns (spins) of a ball for a given sport.

16 Claims, 4 Drawing Sheets

(51) Int. Cl.
*A63B 69/36* (2006.01)
*A63B 69/38* (2006.01)

(52) U.S. Cl.
CPC ... *A63B 2069/0008* (2013.01); *A63B 69/0015* (2013.01); *A63B 69/002* (2013.01); *A63B 69/38* (2013.01); *A63B 2069/401* (2013.01); *A63B 2069/402* (2013.01); *A63B 2209/10* (2013.01); *A63B 2225/20* (2013.01); *A63B 2225/50* (2013.01); *A63B 2243/007* (2013.01)

(58) Field of Classification Search
CPC ..... A63B 69/407; A63B 2069/0008; A63B 69/002; A63B 69/0015; A63B 2069/401; A63B 2209/10; A63B 2225/20; A63B 2225/50; A63B 69/36; A63B 69/38; A63B 2243/007
See application file for complete search history.

(56) References Cited

U.S. PATENT DOCUMENTS 2,935,980 A * 5/1960 Garver ..... A63B 69/409 222/3
2,975,779 A * 3/1961 Pope ..... A63B 69/409 124/64
3,128,753 A * 4/1964 Politzer ..... A63B 69/407 124/32
3,288,127 A * 11/1966 Bullock ..... A63B 69/409 124/73
3,467,383 A * 9/1969 Miermans ..... A63F 5/00 273/405
3,584,614 A * 6/1971 Horvath ..... A63B 69/409 124/56
3,838,676 A 10/1974 Kahelin
3,847,132 A * 11/1974 Schatz ..... A63B 69/409 124/82
3,905,349 A * 9/1975 Nielsen ..... A63B 69/409 124/56
4,014,307 A * 3/1977 Horvath ..... A63B 69/409 124/81
4,077,386 A * 3/1978 Berliner ..... A63B 69/00 124/34
4,241,717 A * 12/1980 Mariani ..... A63B 69/40 124/56
4,501,257 A * 2/1985 Kholin ..... A63B 69/40 124/81
4,570,607 A * 2/1986 Stokes ..... A63B 69/40 124/56
4,906,001 A * 3/1990 Vaughn ..... A63B 69/0075 124/36
5,097,985 A * 3/1992 Jones ..... A63B 47/002 124/48
5,224,701 A * 7/1993 Sciarrillo ..... A63B 69/409 473/439
5,265,583 A 11/1993 Otto
5,337,726 A * 8/1994 Wood ..... F41B 11/68 124/75
5,413,085 A * 5/1995 Kraeft ..... A63B 69/40 124/1
5,735,256 A * 4/1998 Monk ..... F41B 11/641 124/81
5,813,391 A * 9/1998 Johnson ..... A63B 69/40 124/6
5,887,578 A * 3/1999 Backeris ..... F41B 11/57 124/56
7,448,371 B2 * 11/2008 Sapir ..... F41B 7/08 124/16
7,581,538 B2 * 9/2009 Kelly ..... A63B 69/409 124/81
7,603,998 B2 * 10/2009 Finstad ..... F41B 11/00 124/73
7,665,454 B1 * 2/2010 D'Agostino ..... F41B 3/04 124/5
7,694,452 B2 * 4/2010 Croisetiere ..... A01K 91/02 124/71
7,905,222 B1 * 3/2011 Fenley ..... A63B 69/407 124/16
8,365,711 B2 * 2/2013 Kusiak ..... A63B 69/0002 124/6
9,352,244 B2 * 5/2016 Aguila ..... F41B 7/00
9,623,304 B2 * 4/2017 Clarke ..... A63B 59/20
10,378,865 B1 * 8/2019 Johannaber ..... A63B 60/0081
10,451,377 B1 * 10/2019 Shieh ..... F42B 27/00
2003/0101978 A1 6/2003 Smith et al.
2005/0103318 A1 * 5/2005 Leal ..... A63B 69/409 124/74
2007/0191143 A1 8/2007 Kelly et al.
2014/0111424 A1 * 4/2014 Goetgeluk ..... A63B 71/0622 345/156
2016/0096095 A1 * 4/2016 Williams ..... F41B 3/04 124/5
2016/0213990 A1 * 7/2016 Mamangun ..... A63B 65/122
2017/0080285 A1 * 3/2017 Bentley ..... A63B 22/20
2017/0326414 A1 * 11/2017 York ..... A63B 47/002

FOREIGN PATENT DOCUMENTS

KR 200170819 Y1 * 3/2000
KR 20120065568 A * 6/2012
KR 20120086171 A * 8/2012
KR 20170046893 A * 5/2017

* cited by examiner

FLEX GRIP SPORTS BALL PITCHING MACHINE TIP

BACKGROUND OF THE INVENTION

Field of the Invention

The embodiments herein generally relate to the field of sports equipment. In particular, the embodiments herein are directed to a flexible tip device/apparatus that is configured to impart angular momentum and spin for different sport objects.

Discussion of the Related Art

Aerodynamics of propelled objects, such as a baseball or a football dates back long before the advent of many of the modern game seen today on television. Along with understanding the aerodynamics of configured ball properties, coupled frictional forces that are initially utilized to hold the objects and the directional acceleration for velocity are important to provide what type of pitch for a baseball will result or what type of speed and spiral is beneficial for accuracy in a football.

There are a myriad of mechanical means for reproducing the flight of a sports object, such as spherical object, e.g., a baseball, or a non-spherical object, such as a football so as to simulate that of directing such an object by the human hand. The mechanics of ball flight, however, require that the ball leave a point of projection, at an initial height from the ground and with a given angular momentum in a given direction about an axis oriented in space so as to be directed to a target with a desired flight characteristic (e.g., a curve ball).

The present invention provides a ball throwing apparatus which can exactly control the direction and speed of travel, and the direction and extent of curve of the ball by mechanically and accurately regulating the direction of the plane of rotation and the angle of rotation of the rotary body at the time of projecting the ball. A need still exists for providing such a result and thus the embodiments herein are directed to such a need via the mechanical tip means disclosed herein.

SUMMARY OF THE INVENTION

It is to be appreciated that the present example embodiments herein are directed to a device wherein, a ball is held and then propelled via a linear velocity. Upon release a dissimilar application of friction on the surface of the ball results in the generation of torque and angular momentum. Unlike standard machines that utilize rotational acceleration, the disclosed method herein of propelling the ball is done via linear acceleration, making it somewhat insensitive to the balls shape or markings, such as laces.

Additionally, the reliance on linear velocity allow for a more fine-tuned control over the angular momentum of the ball. Spin rate imparted on a ball is a function piston acceleration and length of travel. Thus, the linear acceleration coupled with the dissimilar friction applied to the ball allows for a vast and novel improvement over what is currently available in the market. In particular, the embodiments shown herein are generally insensitivity to the shape and markings on a ball and because of such a configuration (s), enables a more fine-tuned control of the speed and spin rate of the ball so as to be desirable in the commercial market.

It is thus to be appreciated that an aspect of the present embodiments include a ball machine tip, that includes a base, wherein the base is configured with a thickness to form a coupling aperture about an axis; at least one member protruding outwardly from the base and radially positioned about the coupling aperture, and wherein the at least one member is further configured with an inner surface area shaped to form a tip to receive an object; a first frictional surface area configured on an inner surface of the at least one member to frictionally grip the object, wherein the first frictional surface area is positioned farther from an axis of rotation of the object; a second frictional surface area configured on an inner surface of the at least one member to frictionally grip the object, wherein the second frictional surface area is positioned nearer from an axis of rotation of the received object; and a linear acceleration means secured to the coupling aperture, wherein the first frictional surface and the second frictional surface area enables an imbalance of torque on the object as released from the gripping tip from a velocity provided by the linear acceleration means.

Accordingly, unlike standard machines that utilize rotational acceleration, this methodology and tip/conic section configuration of propelling the ball is done via linear acceleration, making it insensitive to ball shape or markings, such as stiches or laces. Additionally, the reliance on linear velocity allow for a more fine-tuned control over the angular momentum of the ball. The length of the piston used in the acceleration is proportional to the linear speed which then directly influences the spin rate imparted to the ball. Thus, the linear acceleration coupled with the dissimilar friction applied to the ball allow for a vast improvement over what is currently available in the market. Both the insensitivity to the shape and markings on the ball along with the more fine-tuned control of the spin rate of the ball make this device an improvement over what is currently available.

DETAILED DESCRIPTION

Figure 1B:
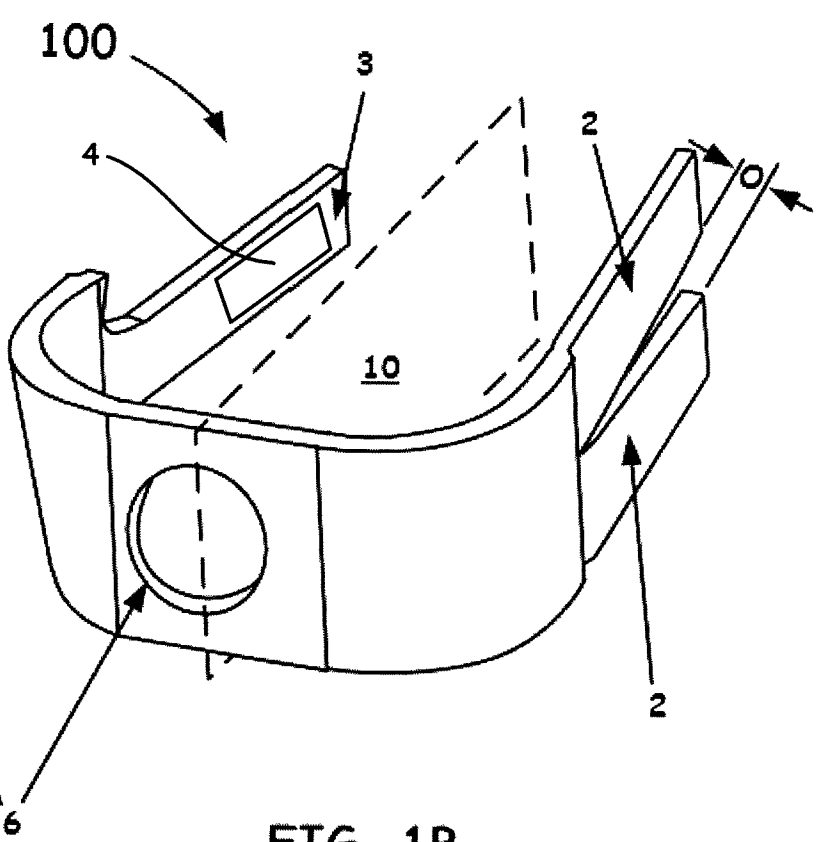
FIG. 1B shows a general depiction of the flex tip configuration shown in FIG. IA pivotably rotated by 90 degrees so as to illustrate imparting a different flight path for a ball.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. It is to be noted that as used herein, the term "adjacent" does not require immediate adjacency. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of such candidates or alternatives is merely illustrative, not limiting, unless implicitly or explicitly understood or stated otherwise.

In addition, unless otherwise indicated, numbers expressing quantities of ingredients, constituents, reaction conditions and so forth used in the specification and claims are to be understood as being modified by the term "about." Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical values, however, inherently contain certain errors necessarily resulting from the standard deviation found in their respective testing measurements.

General Description

To appreciate the general principles herein without being bound by theory, a propelled object such as a baseball or football is affected, among other factors, by the Magnus force, which is a force caused by the interaction of the spin of the ball on the air around it. Such a force determines why objects with topspin tend to fall faster than objects with backspin. The spin, for example, can create such a Magnus force that causes, a ball to curve to the left if thrown by a right-hander, while a left-handed pitcher can make the ball curve to right. The embodiments herein thus capitalize on aerodynamic principles of a ball, to include the Magnus Force, by applying non-constant frictional forces to impart an imbalance of torque while projecting such objects. Sliders and knuckleballs, etc. can also be projected based on, for example, the holding position of the ball also in relation to seam structures if applicable, the velocity of the object when propelled, and the frictional forces applied while directing pitches.

For an ellipsoid object like an American football, the axis is substantially parallel to ground in the long direction, wherein this type of structure when coupled with a rotational component applied by the embodiments disclosed herein, reduces the cross-sectional area in which air resistance can affect the ball. Accordingly, along with spherical types of objects, the embodiments herein substantially mimic individual throws by a football player which thereafter is only affected by gravity, air resistance, and rotational inertial energy.

The device of the embodiments herein can simulate any of the above types of projected types of pitches or throws of balls and can simulate any type of the flight patterns required in the desired sport to include, but not strictly limited to, sports that incorporate baseballs, footballs, cricket balls, tennis balls, golf balls, soccer balls, etc.

Thus, the beneficial aspects of the embodiments disclosed herein are primarily enabled by the use of configured frictional forces placed beneficially in a tip configured with desired frictional coupled materials or integral surfaces arranged about the resultant axis of a disposed sports object be it a baseball, a cricket ball, a football, a tennis ball, a golf ball, etc. The tip can be of a conic configuration, (a cylindrical section, a parabolic section, etc.) or as another beneficial but preferred configuration, the tip can be configured as a rigid or a flexible tip having one or more rigid or resilient members (e.g., fingers) placed in desired points about the resultant axis of rotation of a ball. Similar to the conic section embodiment, the one or more rigid or resilient members of the flexible tip configurations can also be arranged with integral frictional surfaces or coupled (coated or adhesively applied) materials having known frictional properties about any of the aforementioned held sports objects. Such a latter embodiment functionally provides desired effects mirroring that of the beneficial conic embodiments.

It is also to be noted that stitches on a baseball or cricket ball or laces on a football introduce complexity in the generation of lift and drag on the objects configured with such structures. For a baseball, cricket ball or a football, the aerodynamic forces act through an average location, i.e., called the center of pressure on an object. For an ideal, smooth ball, such as a soccer ball. symmetry considerations place the center of pressure at the center of the ball along with the center of gravity. Accordingly, flight patterns of smooth symmetric objects such as soccer balls and to a large degree golf balls can be predictable in flight patterns given a certain velocity and imparted spin. Baseballs or cricket balls and footballs, however, are not smooth and have an asymmetry because of the stitches/seams or laces configurations (note that a cricket ball has a different seam pattern and overall design specifications than a baseball used in the major leagues). Thus, flight patterns of particular objects can be irregular (e.g., a curve ball as opposed to a knuckleball) based on a given velocity and spin and how forces are provided to the seams or laces and how such seams or laces introduce such aerodynamic irregularities. However, it is to be appreciated that because the embodiments use a linear accelerating means, the seams or laces of a ball are less impactful with respect to the overall flight pattern. Nonetheless, the tip/conic frictional members/materials embodiments herein can also be configured on the seams or laces of a given ball structure to propel the specific sports object with a given spin that substantially mimics that of the human hand holding such seams/laces when desired.

The two regimes of friction primarily utilized herein include static friction between non-moving surfaces (as the ball is held by the tips disclosed herein), and kinetic or dynamic friction between the moving surfaces (the movement of, for example a ball as it is being released from the contact points of the tips disclosed herein). A figure of merit to note and as used herein is the coefficient of friction, as clearly known and understood by those of ordinary skill in the art, which is an empirical property of the contacting materials/surfaces disclosed herein. As to be reiterated below, coefficients of friction of the contacting materials/surfaces ranges from about 0.04 up to about 2 to provide a wide variety of frictional contacting materials and/or integrally formed surfaces.

Thus, is to be appreciated that the general principle of the embodiments herein is to provide one or more higher frictional materials or surfaces (often but not necessarily having coefficients of friction in the upper range disclosed above) most often farther from the axis of rotation of a held object to generate the highest amount of frictional force on the surface of the ball while also provided one or more lower frictional materials or surfaces (having coefficients of friction more to the lower range disclosed above) and thus lower resistive frictional forces closer to the axis of rotation axis, which decreases the moment arm of the held object. The bottom line is that the utilization of frictional contact points as disclosed herein and as configured about at the surface of a ball leads to torque which leads to rotation. Such a configuration leads to an imbalance of torque, which is what causes the ball to rotate. Thus, for example, if the higher and lower frictional components are configured on the tip wherein the imbalance of torque induces topspin on a baseball, the top of the ball moves in the same direction as the throw and against the flow of air (i.e., drag creates a higher-pressure region and lower velocity) relative to the direction of the throw. By contrast, the bottom of the ball because of the imparted spin, is moving in the direction as the air flow relative to the throw. Because of the higher pressure on the top of the ball, the ball is induced to break downward or curve as determined by physics/aerodynamic known principles. Accordingly, depending on the orientation of the tips/conic configurations, the imparted velocity, the imbalance of torque applied as coupled to the balls using applied frictional contact points, and in considering seam/lace orientations, a ball can be given any number of hand like flight patterns (i.e., spin) using the embodiments herein.

There are tradeoffs, however, to moving the less frictional surfaces or components too close to the axis of rotation. If you move too far, then you do not oppose the normal force from the higher frictional surfaces or components configured on the tips, as disclosed herein. Accordingly, if you don't have normal force, then you do not have frictional force to provide desired rotations.

Specific Description

Figure 1A:
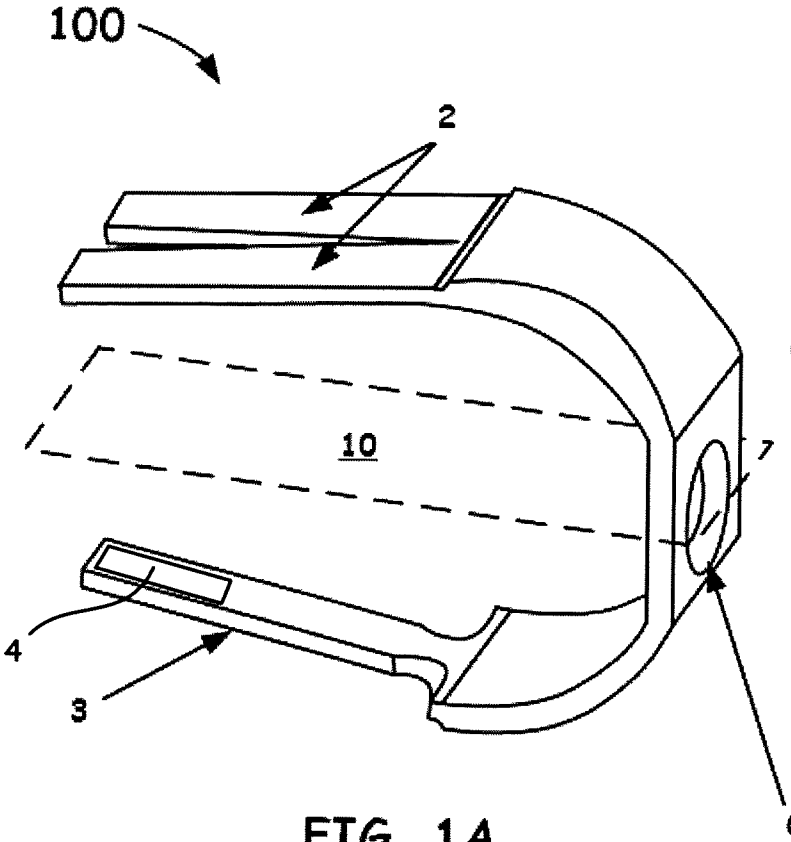
FIG. 1A shows an example general depiction of a flex tip configuration, as disclosed herein.

Turning now the drawings, FIG. 1A and FIG. 1B in combination show a first example embodiment of a baseball, football, golf ball, soccer ball or cricket pitching machine tip, as disclosed herein. In general, to illustrate the workings of the present invention, FIG. 1A and FIG. 1B in particular, show a grasping tip having a frame (e.g., generally shown as a non-limiting U-shaped frame) configuration, as generally referenced by the numeral 100. The tip 100 includes a plurality of tabs/members or surfaces 2, 3 (three total shown in FIG. 1A and FIG. 1B as an example embodiment) opposite with respect to each other about a central (sagittal) plane (10).

Such tabs/members or surfaces 2, 3, as discussed above, can either have designed frictional surfaces with different coefficients of friction (e.g., using machine knurling, teeth, etc.) on the inner surfaces 4 (only one shown on tab/member 3 for simplicity) or have coupled (coated or adhesively applied) materials (also denoted as reference character 4) on each of the tabs/members 2, 3 to provide the desired frictional properties. As a beneficial example arrangement, tabs 2 can be configured with higher frictional surfaces/materials while tab 3 can be configured with the lower frictional surface/material or vice versa so as to provide a resultant imbalance of torque. Also shown is a coupling aperture 6 at the base of the frame that enables, for example, a coupled shaft (not shown) as part of accelerating means (not shown) to be disposed therethrough and secured by means understood by those of ordinary skill in the art, s discussed below.

Once tabs/members 2, 3 are in contact with a desired sports object, such as a baseball or a cricket ball, or a football, etc., the applied compressive (static holding) and kinetic frictional forces imparts an imbalance of torque/desired spin as the ball is given a forward linear acceleration. Such linear acceleration can often be provided by a commercial or custom made pneumatic canon type, linear slide and/or piston driven linear accelerator, capable of producing, for example, linear speeds between 20 miles per hour (mph) and 200 mph.

The tip 100 is often, but not necessarily, of a one-piece construction and formed of a length of a suitable material such as, but not limited to plastics, thermoplastics (e.g., Delrin), but more often a metal, such as steel, aluminum, alloy, or any other suitable material of strength, stiffness, resiliency and toughness capable of being configured in the aforementioned configuration(s), as generally shown in FIG. 1A and FIG. 1B, or any of the configurations to be discussed that follows.

It is to be noted that FIG. 1A shows the configuration of the tip 100 having its sagittal plane 10 (as also denoted as a dashed rectangle) arranged horizontally wherein the tip 100 and thus the sagittal plane 10 can be pivotably rotated about 360 degrees for desired throwing orientations of a sports object held thereby. For example, the sagittal plane 10 shown in FIG. 1B and thus the tip 100 itself can be pivotably rotated 90 degrees to that of the configuration of FIG. 1A so to impart a different axis of rotation (spin). Such a capability of differing orientations enable a variety of pitches to include when changing linear acceleration velocities of the tip and the given object (e.g., a cricket ball, etc.).

Figure 2B:
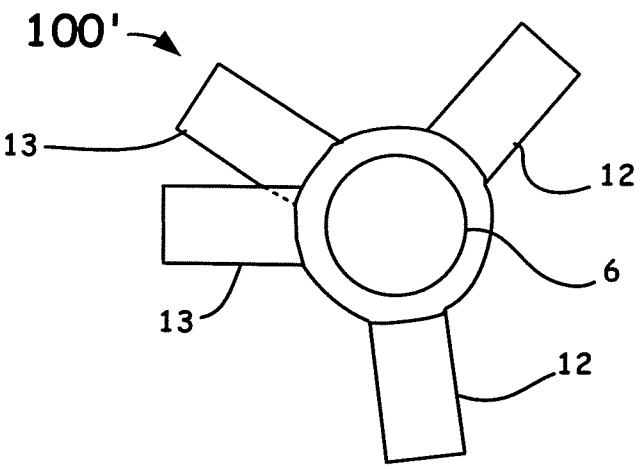
FIG. 2B shows an end view of the flex tip configuration shown in FIG. 2A.
Figure 2A:
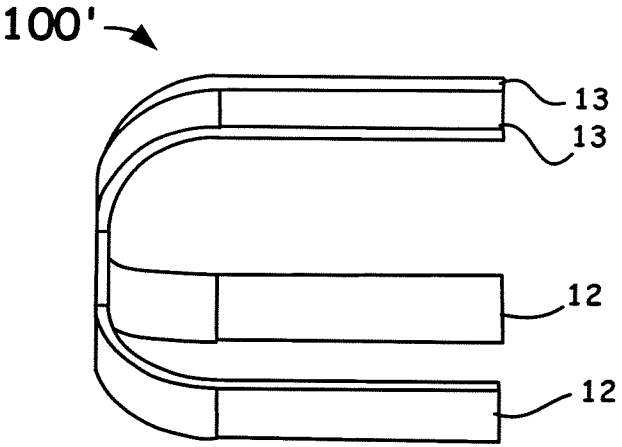
FIG. 2A shows a side view of a second (e.g., four-member) flex tip configuration, as disclosed herein.
Figure 2C:
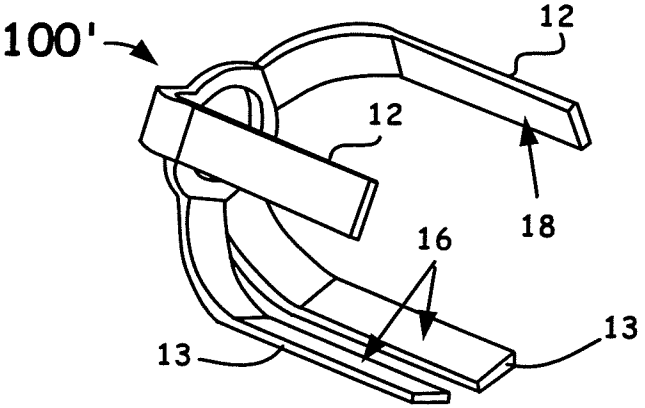
FIG. 2C shows a 3D perspective view of a four-member flex tip configuration.

FIG. 2A, FIG. 2B, and FIG. 2C show collectively another example embodiment of a baseball, football, golf ball, soccer ball or cricket pitching machine tip, as disclosed herein. It is to be noted that like reference numerals are utilized where warranted for similar components and/or structures as previously discussed or as to follow in the discussion(s) below. FIG. 2A in particular, shows a side view, FIG. 2B shows an end view rotated about a plane with respect to FIG. 2A, and FIG. 2C shows a 3D perspective view of a four-member flex tip also having generally but not necessarily, a U-shaped configuration, as now referenced by the numeral 100'.

The tip 100', similar to that shown in FIG. 1A and FIG. 1B includes a plurality of tabs/members or surfaces 12, 13 (four total as the example embodiment) positioned about a soon to be imposed rotational axis (not shown) of a disposed sports object (baseball) therein. Similar to the discussion above, as an example arrangement, tabs/members 12 can be configured with higher frictional surfaces/materials while tabs 13 can be configured with the lower frictional surface/material or vice versa so as to provide a resultant imbalance of torque. It is to be noted that while the tip embodiment 100 of FIG. 1A and FIG. 1B shows three members/tabs (e.g., 2, 3) and FIG. 2A, FIG. 2B, and FIG. 2C show four (two denoted by the reference numeral 12 and two denoted by the reference numeral 13). However, the embodiments herein are not limited to just those number of tabs/members.

Such tabs/members or surfaces 12, 13, similar to the discussion for the tip 100 above, have designed frictional surfaces with different coefficients of friction (e.g., using machine knurling, teeth, etc.) or have designed frictional coated or coupled surfaces materials as discussed below and as similar to the discussion above for the tip 100, shown in FIG. 1A and FIG. 1B. Also, as shown similar to that in FIG. 1A and FIG. 1B, is the coupling aperture 6, as best denoted in the end view of FIG. 2B that enables securing to an accelerating means.

As an exemplary arrangement, FIG. 2C is used to illustrate where the tab/members (e.g. tabs/members 13 for teaching purposes) can have integrally designed frictional surfaces or coated/adhesively coupled materials 16, such as rubber, located to provide the higher frictional surfaces. FIG. 2C also illustrates where certain tabs/members 12 can have less frictional designed surfaces or coated/coupled materials 18 (e.g., Teflon) relative to that of tab/members 16 (frictional designed surfaces or coated/coupled materials not specifically detailed) to provide the imbalance of torque as the ball is released after acceleration. It is to be noted that the frictional surfaces/materials can be reversed when desired.

As before, once tabs/members 12, 13 are in contact with a desired sports object, such as a baseball or a cricket ball, football, etc., the applied compressive (static holding) and kinetic frictional forces imparts an imbalance of torque/desired spin as the ball is given a forward linear acceleration. The tip 100' is also often, but not necessarily, of a one-piece construction, width, thickness, shape and length similar to that for tip 100, as shown in FIG. 1A and FIG. 1B. Moreover, the length, width, thickness, and shape of the tabs/members 12, 13 can also be varied along with the length, width, thickness and shape of the frictional contacts to provide desired flight patterns of a ball.

As also discussed above for the tip 100, the tip 100' as shown in FIG. 2A, FIG. 2B, and FIG. 2C can be pivotably rotated about 360 degrees for desired throwing orientations of a sports object held thereby so as to impart different pitches when imparting a desired spin.

However, it is to be appreciated that the tips, 100, 100' (and 100", as discussed below for FIG. 3A and FIG. 3B) can also be configured with frictional and compressive forces to "not" produce a particular imbalance of torque and thus minimize spin on the ball so as to enable knuckleballs, as known to those skilled in the art. Preferably, once the tip 100, 100' or 100" is fastened to, for example, a piston end of a linear accelerator means, the tip 100 or 100' or 100" can be pivotably rotated and specifically oriented to produce any spin axis perpendicular to the linear acceleration direction, as discussed above for FIG. 1A and FIG. 1B, thus simulating a variety of pitches (e.g., curve ball, cutter, slider, etc.) Moreover, tips 100 and 100' 100" are also not limited to just being coupled and propelling a baseball, or cricket ball or spherical balls for that matter, but can be configured to hold and provide desired flight patterns of, for example, oblong-shaped objects like an American football so as to produce spiral spin that has a spin axis parallel to the flight path.

Figure 3B:
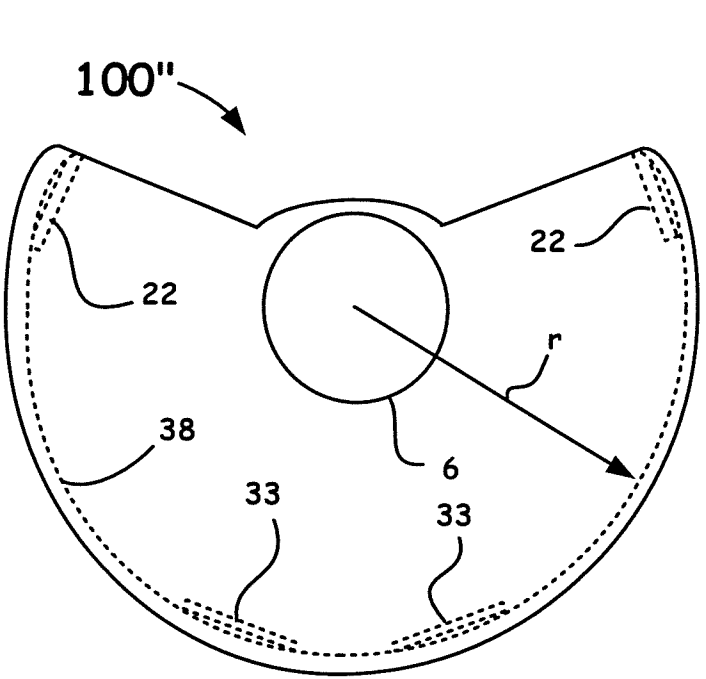
FIG. 3B shows an end view of the conic sectioned flex tip configuration shown in FIG. 3A.
Figure 3A:
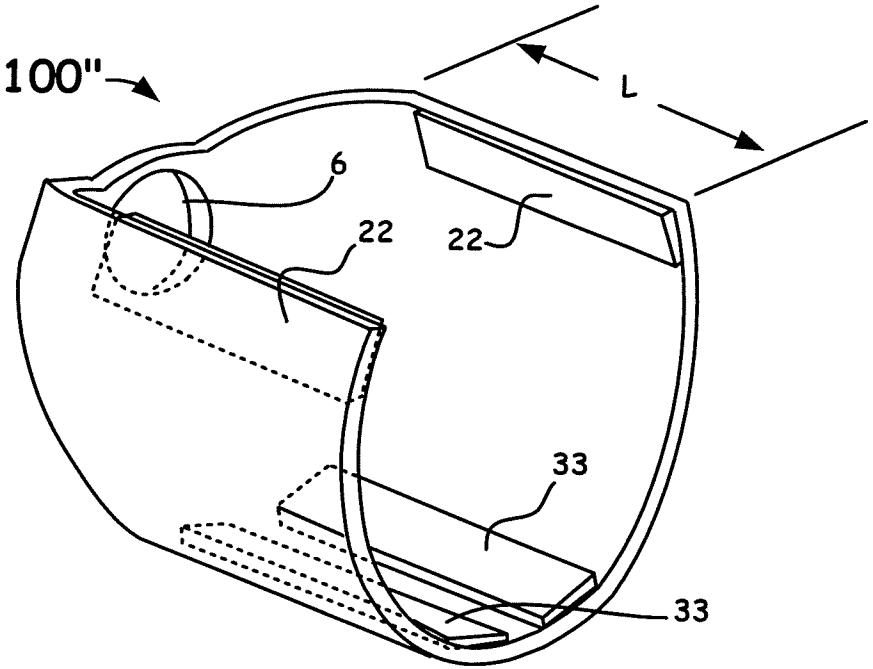
FIG. 3A shows a 3D perspective view of a conic sectioned flex tip configuration.

As also briefly discussed above, the tips 100 and 100' of FIG. 1A, FIG. 1B, FIG. 2A, FIG. 2B, and FIG. 2C and the tip 100" shown in FIG. 3A and FIG. 3B are also capable of being beneficially coupled to an accelerating means component such as, but not limited to, a commercial or custom made pneumatic canon type, linear slide and/or piston driven linear accelerator, capable of producing, for example, linear speeds between 20 miles per hour (mph) and 200 mph. Moreover, it is to be noted that the point of release of the tip 100 or 100', 100" can be manipulated to direct the ball high, low, toward or away from an intended target, such as, for example a batter or a receiver in a designated spot, or to direct a cricket ball or football to an area with spin as desired.

In order that the device impart spin to the ball about other rotational axis, a rotatable connection is employed to a given shaft (not shown), using for example, coupling aperture 6 at the base of the frame, as shown in FIG. 1A and FIG. 1B or as shown in FIG. 2A through FIG. 2C or FIG. 3A and FIG. 3B.

Accordingly, the tip 100, 100', 100" may be arranged to impart spin to the ball in any desired direction by rotating, for example the tip orientations (e.g., illustratively by manipulating the sagittal plane 10 shown in FIG. 1A and FIG. 1B), in different positions of rotation with respect to a perpendicularly coupled shaft. As another embodiment, straight balls (e.g., fast balls) can still be delivered by, as one arrangement, removing a tip 100, 100', 100" as shown in FIG. 1A and FIG. 1B, or as shown in FIG. 2A through FIG. 2C or FIG. 3A and FIG. 3B. as coupled to a given accelerating mechanism.

FIG. 3A and FIG. 3B show collectively another example embodiment of a baseball, football, golf ball, soccer ball or cricket pitching machine tip, as disclosed herein (dashed lines indicate hidden surfaces). FIG. 3A in particular, now shows a 3D perspective view of a conic sectioned flex tip and FIG. 3B shows an end view of the configuration, as generally now referenced by the numeral 100". The tip 100", although somewhat similar in principle to that shown in FIG. 1A and FIG. 1B and FIGS. 2A-2C now has situated the frictional surfaces 22, 33 with different coefficients of friction configured to be coupled to an inner surface area 38, as shown in FIG. 3B of the conic sectioned flex tip 100".

The conic section design, as shown in FIG. 3A, can thus have a length (L) and with a radius of curvature (r), as shown in FIG. 3B that substantially matches that of a conic surface structure so as to propel sports balls of any diameter (baseballs, soccer balls) or having irregular shapes (footballs). Such conic structures include but are not limited to cylinders, ellipses, parabolics, etc.

If designed as a cylinder conic, the tip 100", as shown in FIG. 3A and FIG. 3B can operate similar to the tip 100' configuration disclosed above, for example, as shown in FIG. 2C by situating the differential frictional surfaces/members about the inner surface area 38 so as to impart a desired imbalance of torque. Parabolic example structures and other conics can functionally operate to scoop objects and project them. An example would be a golf ball sitting on a tee, wherein the tip 100" is directed to scoop the ball and project it with a given flight pattern.

As a general principle, a ball is placed so as to be contained within the radius area of the tip 100", as shown in FIG. 3A. The designed frictional surfaces or coated/adhesively coupled materials 22 or 33 such as rubber, can be located empirically or scientifically to provide the higher frictional surfaces and the coupled materials having lower frictional surfaces (e.g., 33 or 22), such as teflon, can also be situated using such methods as well.

FIG. 2C illustrates graphically where certain tabs/members 22, 33 (shown as dashed lines) are capable of being positioned and of which can have lesser or higher frictional designed surfaces or coated/coupled materials to provide the imbalance of torque as the ball is released after acceleration, similar to any of the discussions above for tips 100 and 100'.

As before, while FIG. 3A and FIG. 3B show four frictional surfaces/materials 22, 33 configured on the inner surface of tip 100", the embodiments herein are not limited to just those number of tabs/members but can be adjusted in number and design accordingly where warranted. Also shown similar to FIG. 1A and FIG. 1B, is the coupling aperture 6, as denoted in the end view of FIG. 2B that enables securing to an accelerating means.

To reiterate, once tabs/members 22, 33 are in contact with a desired sports object, such as a baseball or a cricket ball, football, etc., the applied compressive (holding) force imparts an imbalance of torque/desired spin as the ball is given a forward linear velocity when leaving the rip 100". The tip 100" is often, but not necessarily, of a one-piece construction and length formed of a length (L), as shown in FIG. 3A. Moreover, the length, width, thickness, and shape of the tip 100" can also be varied along with the length, width, thickness and shape of the frictional contacts 22, 33 (surfaces/material) to provide desired flight patterns of a ball. As also discussed above for the tip 100 and the tip 100' as discussed above, the tip 100", as shown in FIG. 3A and FIG. 3B, such embodiments can be pivotably rotated about 360 degrees for desired throwing orientations of a sports object held thereby so as to impart different pitches when imparting, for example, spin.

However, it is also to be appreciated that the tips, 100, 100' and 100" can also be configured with frictional and compressive forces to "not" produce a particular imbalance of torque and thus minimize spin on the ball so as to enable knuckleballs, as known to those skilled in the art. Preferably, once the tip 100, 100' or 100" is fastened to, for example, a piston end of a linear accelerator means, the tip 100 or 100' or 100" can be freely pivotably rotated and specifically oriented to produce any spin axis perpendicular to the linear acceleration direction, as discussed above for FIG. 1A and FIG. 1B, thus simulating a variety of pitches (e.g., curve ball, cutter, slider, etc.).

Moreover, it is also to be stressed that the tips 100 and 100', and 100" are also not limited to just being coupled in a manner for propelling a baseball, or a cricket ball or spherical balls for that matter, but can be configured to hold and provide desired flight patterns of, for example, oblong-shaped objects like an American football so as to produce spiral spin that has a spin axis parallel to the flight path.

As also briefly discussed above, the tips 100, 100' and 100", as shown in the example embodiments of FIG. 1A, FIG. 1B, FIG. 2A, FIG. 2B, FIG. 2C and FIG. 3A-3C are also capable of being beneficially coupled to an accelerating means component such as, but not limited to, a commercial or custom made pneumatic canon type, linear slide and/or piston driven linear accelerator, capable of producing, for example, linear speeds between about 20 miles per hour (mph) and 200 mph.

Figures 4A, 4B:
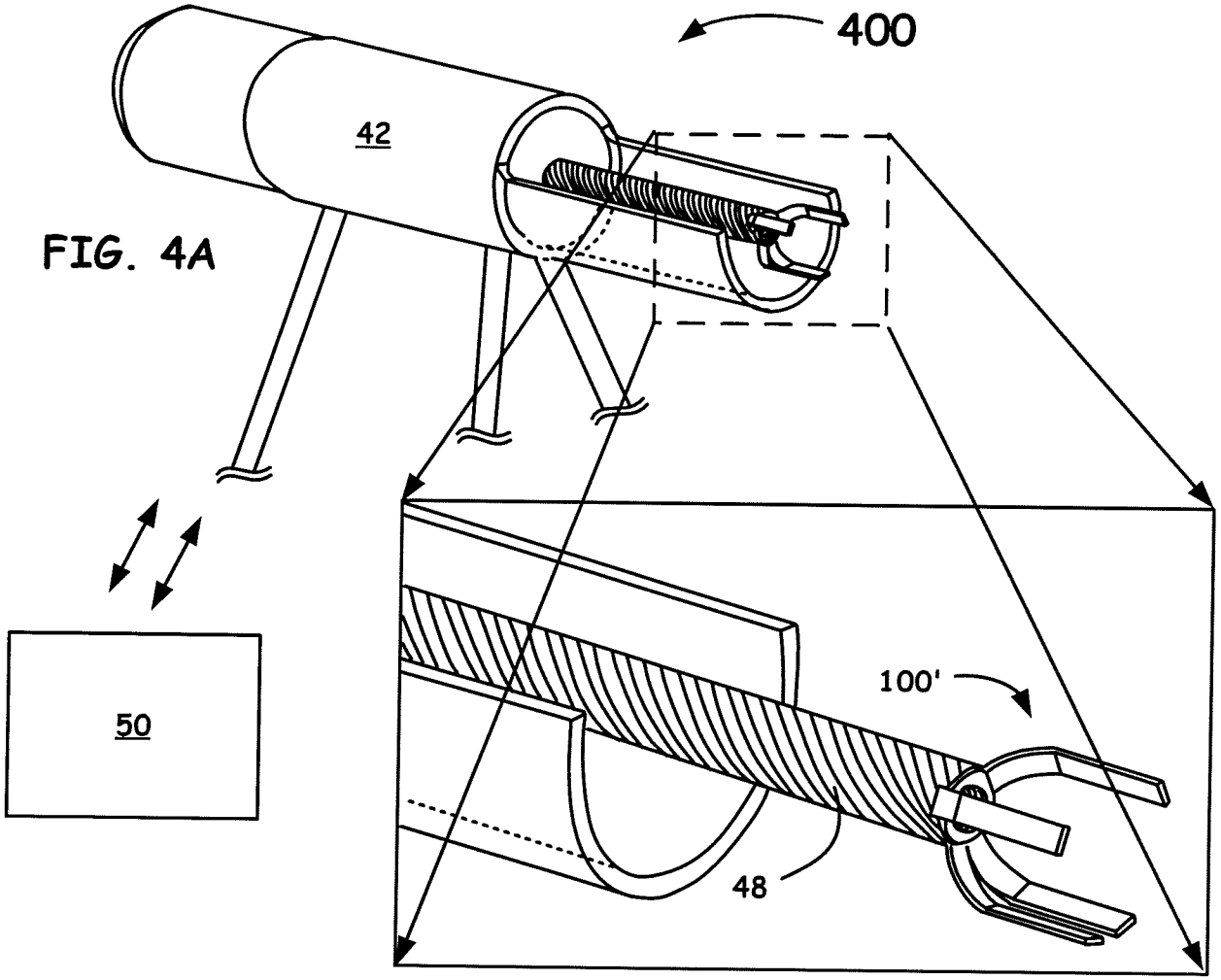
FIG. 4A shows an example linear accelerator means/tip system 400, as disclosed herein.
FIG. 4B shows an exploded view of the tip coupled to a shaft of the linear accelerator means shown in FIG. 4A.

FIG. 4A shows such an example linear accelerator means as coupled to a tip (e.g., the tip 100' of FIG. 2A-FIG. 2C) system 400 while FIG. 4B shows an exploded view of the tip 100' coupled to a shaft of the linear accelerator means 42.

In particular, just for ease of understanding, the accelerator means 42 can be any of the aforementioned instruments generally described above (e.g., a pneumatic canon type). A tip (e.g., tip 100') is thus fastened to the shaft 48 using the example coupling aperture 6, as was illustrated in FIG. 2C.

Using tip 100' as an example but applicable to other embodiments disclosed herein, a disposed ball is held in place by the overall frame construction and is in contact with the upper 12 (e.g., fingers/members) and lower tabs 13 shown in FIG. 2A through FIG. 2C and thus the also coupled frictional surfaces/materials (e.g., 18, as discussed above for FIG. 2C). When the accelerator is fired, the coupled tip 100' (can also be tips 100 and 100") compresses the article (ball) and both are accelerated and when the piston (shaft 42) reaches the end of its stroke the ball continues forward, sliding on the low friction tab(s) and frictionally gripping more on the high friction tabs so as to impart the imbalance of torque and thus a given, if desired, overall flight pattern (e.g., a ball with spin (e.g., curves) or even a substantially non-rotating (fastball). Moreover, it is to be noted that the point of release of the tip 100 or 100', or 100" can be manipulated to direct the ball high, low, toward or away from an intended target, such as, for example a batter or a receiver in a designated spot, or to direct a cricket ball or football to an area with spin as desired.

It is to also be noted that system 400, as shown FIG. 4A, can also be directly or remotely directed by a controller and data system (generally shown by reference numeral 50 double directional arrows) of various circuitry of a known type. Such a control and data system 50 can thus be in the form of a desktop computer, a laptop computer a network server, a server computer, or can be implemented by any one of or a combination of general or special-purpose processors (digital signal processor (DSP)), firmware, software, and/or hardware circuitry to provide instrument control, data analysis, etc., for the example configurations disclosed herein.

Individual software modules, components, and routines may also often be utilized by system 400, as shown in FIG. 4A in the form of a computer program, procedure, or process written in a suitable programming language, e.g. C, C#, C++. In addition, the computer programs, procedures, or processes may be compiled into intermediate, object, or machine code and presented for execution as instructions and control functions, so as to be implemented by system 400. Various implementations of the source, intermediate, and/or object code and associated data may also be stored in one or more computer readable storage media that include read-only memory, random-access memory, magnetic disk storage media, optical storage media, flash memory devices, and/or other suitable media. As used herein, the term "computer readable storage media" excludes propagated signals, per se and refers to media known and understood by those of ordinary skill in the art, which have encoded information provided in a form that can be read (i.e., scanned/sensed) by a machine/computer and interpreted by the machine's/computer's hardware and/or software.

In some embodiments, system 400 can be connected to other devices over other types of networks, including isolated local area networks and/or cellular telephone networks. The connection can also be a wireless connection or a physical coupling. As non-limiting examples of a wireless connection, such an arrangement can include commercial wireless interfaces, such as but not limited to, radio waves (WiFi), infrared (IrDA), or microwave technologies that also allow integration into available portable personal devices, such as, but not limited to, cell phones, pagers, personal identification cards, laptops, etc. The wireless communication can thus provide signals, including alert messages if detected, programmatic control instructions (e.g., velocity applied by system 400), etc.

With respect to physical wired coupling, the coupling can be by way of a dedicated coupling I/O means, such as a USB port (not shown) to provide, for example, operational data (feedback) via the embedded software (e.g., firmware) or instructions received from or to system 400 using, as one arrangement, controller and data system 50.

In some embodiments, system 400 can also include an internet-based configuration interface that enables remote adjustment of configuration options and operating parameters. The interface can be accessible via a web browser, for example, over a secured or insecure network connection. The internet-based configuration interface permits remote updating of system 400 by a central computer system or another device, ensuring that any or all systems if desired, are operated with similar or even dissimilar configurations.

To reiterate novel aspects of the embodiments disclosed herein, dissimilar coefficients of friction, as discussed above, configured about the tips disclosed herein leads to the aforementioned imbalance of torque about the sides of the ball upon release. The dissimilar coefficients of friction must be of relatively degree to cause the ball to rotate when desiring spin. While a desired surface friction can be integrally provided to the inner surfaces of the tabs/members/fingers or the inner surfaces of conic sections (member), as discussed in detail above, preferred applied (e.g., coated or adhesively coupled) materials as stated throughout the former corners of the document herein, often include rubber as the higher frictional material with Teflon being that of the lower frictional material.

The materials or surfaces themselves are designed to provide an imbalance of torque. However, while rubber and teflon are preferred, such materials or surface(s) can be designed with coefficients of friction ranging from at least 0.04 (kinetic to static coefficients of friction of teflon is in this range) up to about 2 (static to kinetic coefficients of friction for rubber ranges between 0.6 up to about 1.0) to provide a wide variety of frictional surfaces and materials not just limited to teflon and rubber.

It is to be understood that features described with regard to the various embodiments herein may be mixed and matched in any combination without departing from the spirit and scope of the invention. Although different selected embodiments have been illustrated and described in detail, it is to be appreciated that they are exemplary, and that a variety of substitutions and alterations are possible without departing from the spirit and scope of the present invention.

We claim:

1. A ball machine, comprising:

a tip comprising a base, wherein the base is configured with a thickness to form a coupling aperture;

at least one member protruding outwardly from the base and radially positioned about the coupling aperture, and wherein the at least one member is further configured with an inner surface area shaped to receive an object;

a first frictional surface area configured on the inner surface of the at least one member at a first location to frictionally grip the object, wherein the first frictional surface area has a first coefficient of friction;

a second frictional surface area configured on the inner surface of the at least one member at a second location different from the first location to frictionally grip the object, wherein the second frictional surface area has a second coefficient of friction; and a shaft secured to or securable to the base of the tip at the coupling aperture to hold the tip at a selected orientation, wherein the shaft and tip are moveable linearly along an axis between a start point and a stop point, wherein the object is released from the tip when the shaft and tip reach the stop point, wherein the tip is rotatable to selected positions so as to control an orientation of the first frictional surface area and the second frictional surface area relative to the object received in the tip, wherein spin characteristics are imparted to the object as it is released from the tip by at least a plurality of the first coefficient of friction, the second coefficient of friction, and the selected orientation of the tip.

2. The ball machine of claim 1, wherein the at least one member protruding outwardly from the base of the tip comprises a plurality of members protruding outwardly from the base, wherein the first frictional surface area is configured on the inner surface of one or more of the plurality of members and the second frictional surface area is configured on the inner surface of one or more of the plurality of members.

3. The ball machine of claim 2, wherein the plurality of members protruding outwardly from the base comprises at least three members.

4. The ball machine of claim 1, wherein the at least one member protruding outwardly from the base comprises a single conic section member, wherein the first frictional surface area is configured on one or more radial positions of the inner surface, and wherein the second frictional surface area is configured on one or more radial positions on the inner surface.

5. The ball machine of claim 4, wherein the single conic section comprises at least one of a cylinder section, a parabolic section, and an elliptical section.

6. The ball machine of claim 4, wherein the first coefficient of friction and the second coefficient of friction each range from about 0.04 up to about 2.

7. The ball machine of claim 1, wherein the first coefficient of friction and the second coefficient of friction each range from about 0.04 up to about 2.

8. The ball machine of claim 7, wherein the first coefficient of friction is greater than the second coefficient of friction.

9. The ball machine of claim 7, wherein the first frictional surface area and the second frictional surface area are materials coated on the inner surface.

10. The ball machine of claim 7, wherein the first frictional surface area and the second frictional surface area are adhesively coupled materials.

11. The ball machine of claim 7, wherein the first frictional surface area and the second frictional surface area are integrally formed on the inner surface of the least one member.

12. The ball machine of claim 1, wherein the first frictional surface area is rubber and the second frictional surface area is teflon.

13. The ball machine of claim 1, wherein the tip is configured from at least one material selected from the group consisting of plastics, thermoplastics, a metal, and an alloy.

14. The ball machine of claim 1, wherein the tip is configured to receive a sports object selected from the group consisting of a baseball, a cricket ball, a football, a soccer ball, a tennis ball, and a golf ball.

15. The ball machine of claim 1, wherein the shaft and tip are moved linearly by a device selected from the group consisting of a pneumatic canon, a linear slide and a piston driven linear accelerator.

16. The ball machine of claim 15, wherein the device is configured to provide velocities from about 20 miles per hour up to about 200 miles per hour to the shaft and tip during linear movement.

* * * * *